US007746281B2

(12) United States Patent
Yamada

(10) Patent No.: US 7,746,281 B2
(45) Date of Patent: Jun. 29, 2010

(54) ANTENNA MOUNTING ASSEMBLY

(75) Inventor: Takeshi Yamada, Kariya (JP)

(73) Assignee: DENSO CORPORATION, Kariya (JP)

( * ) Notice: Subject to any disclaimer, the term of this patent is extended or adjusted under 35 U.S.C. 154(b) by 403 days.

(21) Appl. No.: 11/826,839

(22) Filed: Jul. 19, 2007

(65) Prior Publication Data

US 2008/0030414 A1 Feb. 7, 2008

(30) Foreign Application Priority Data

Aug. 2, 2006 (JP) ..... 2006-211239

(51) Int. Cl.
*H01Q 1/32* (2006.01)

(52) U.S. Cl. ..... 343/713; 343/711

(58) Field of Classification Search ..... 343/713, 343/711

See application file for complete search history.

(56) References Cited

U.S. PATENT DOCUMENTS

2002/0158805 A1* 10/2002 Turnbull et al. ..... 343/713
2006/0262018 A1* 11/2006 Mikami et al. ..... 343/713
2007/0171137 A1* 7/2007 Mierzwa et al. ..... 343/713
2007/0182649 A1* 8/2007 Kondou ..... 343/713

FOREIGN PATENT DOCUMENTS

| | | |
|---|---|---|
| JP | A-11-301363 | 11/1999 |
| JP | A-2003-152411 | 5/2003 |
| JP | A-2004-276770 | 10/2004 |
| JP | A-2004-345397 | 12/2004 |
| JP | A-2004-356891 | 12/2004 |

* cited by examiner

*Primary Examiner*—HoangAnh T Le
(74) *Attorney, Agent, or Firm*—Posz Law Group, PLC

(57) ABSTRACT

An antenna mounting assembly includes a stopper, a side wall, a retainer, and a fall-prevention latch on an instrument panel side of the assembly as an integral part of the panel. The fall-prevention latch and a folded part are engaged with each other for holding an antenna body. On the other hand, the antenna body is released from the instrument panel by disengaging the fall-prevention latch from the folded part.

5 Claims, 8 Drawing Sheets

ANTENNA MOUNTING ASSEMBLY

CROSS REFERENCE TO RELATED APPLICATION

This application is based on and claims the benefit of priority of Japanese Patent Application No. 2006-211239 filed on Aug. 2, 2006, the disclosure of which is incorporated herein by reference.

FIELD OF THE DISCLOSURE

The present disclosure generally relates to a vehicular antenna structure for mounting and dismounting an antenna assembly on an instrument panel.

BACKGROUND INFORMATION

There is a recent tendency to multi-function vehicles possessing not only such basic functions as running, turning and stopping but also a navigation function which utilizes position measurement by a Global Positioning System (GPS) and a vehicle-to-vehicle communication function. This tendency is becoming more and more conspicuous in quick tempo. Besides, importance is being attached to the design in both interior and exterior of a vehicle. Keeping steps with such a tendency, there also is a tendency that various parts and parts assemblies for fulfilling various functions are attached to the inside of an instrument panel. For example, an antenna assembly for receiving radio waves from road machines such as a GPS and an Electronic Toll Collection (ETC) system is also attached to the inside of an instrument panel. As shown in FIG. 9, the antenna assembly is attached to a central position of a vehicle front portion in order to keep a good radio wave receiving condition. In FIG. 10, a central part in the transverse direction of a vehicle is cut in the longitudinal direction of the vehicle and the result is shown in terms of a schematic sectional view. An approximate position of an antenna assembly attached to the inside of the instrument panel is shown in the same figure.

In connection with a configuration for mounting the antenna assembly to the instrument panel of a vehicle, such a technique as shown in FIGS. 11 to 13 is disclosed in Japanese patent literature JP-2004-276770A. FIG. 11 is a sectional view wherein the antenna assembly and the vicinity thereof shown in FIG. 10 are enlarged and the appearance of the antenna assembly as attached to the instrument panel is shown in more detail. In the illustrated configuration, an antenna body 31, together with a bracket 13, constitutes an antenna assembly 30 (see also FIGS. 12A and 12B). Further, the antenna assembly 30 is fixed to an instrument panel 10 together with a bracket 12 which is clamped and fixed with screws 14 to a mounting boss 11 of the instrument panel 10.

In order to effect such an assembly as shown in FIG. 11, first, as a preliminary operation, the antenna body 31 is attached to the bracket 13 to complete the antenna assembly 30, as shown in FIGS. 12A and 12B. Thereafter, the antenna assembly 30 is attached to the bracket 12 and lastly the bracket 12 is secured with screws 14 to the mounting boss 11 of the instrument panel 10.

In the above configuration, as shown in FIGS. 13A and 13B, the mounting of the antenna assembly 30 to the bracket 12 is performed by fitting engagement between a fitting portion 15 which is formed on the bracket 12 so as to project upward and a fitting hole 16 formed in the bracket 13. The mounting in question is easy and does not require such parts as screws. Thus, the configuration is simplified. A worker for the mounting is merely required to slide the bracket 13 in A' direction until fitting of the fitting portion 15 into the fitting hole 16 along with a guide portion 17 of the bracket 12.

There sometimes is a case where the check of performance and replacement of antenna is required after mounting the antenna assembly 30 to the bracket 12 and fixing it to the instrument panel 10. In this case, by disengaging the fitting portion 15 and the fitting hole 16 from each other and sliding the antenna assembly in the direction of A, the antenna assembly 30 can be removed easily from the instrument panel 10 (the bracket 12 integral with the instrument panel 10).

At present, since there are a wide variety of vehicle models, the shape of an instrument panel and the layout of parts attached to the instrument panel differ each vehicle model. It is an essential premise that an antenna assembly should be mounted without interference with other parts attached to the instrument panel.

However, in the mounting structure referred to above in connection with the description of the background, in order to avoid the above-mentioned interference, it is necessary that the bracket 12 for fixing the antenna assembly 30 to the instrument panel 10 be designed and fabricated correspondingly to the instrument panel shape and parts layout which differ for each vehicle model. Besides, the bracket 12 is absolutely necessary. Thus, there is a problem of an increase in the number of parts. Moreover, the screws 14 are needed for securing the bracket 12 to the instrument panel. Also in this point the problem of an increase in the number of parts is encountered.

Further, when mounting the bracket 12 to the instrument panel 10, the instrument panel 10 before mounting thereof to the vehicle is turned inside out and a mounting work is performed, with a back side 10-1 up, to tighten the screws 14. However, the working space is limited because many other parts and parts assemblies are installed in the interior of the instrument panel 10. Thus, the screwing work is not easy. If the worker should drop any of the screws 14 to the interior of the instrument panel 10 by mistake during the work, it is difficult to recover the dropped screw.

SUMMARY OF THE DISCLOSURE

In view of the above and other problems, the present disclosure provides an antenna mounting assembly that allows easy mounting and dismounting of an antenna body without an increase of the number of assembly parts.

The antenna mounting assembly of the present disclosure includes an instrument panel side mounting section that is integrally formed with an instrument panel of a vehicle having a first engagement unit formed thereon and a bracket that holds a body of an antenna having a second engagement unit formed thereon. When the first engagement unit and the second engagement unit are engaged with each other, the bracket holding the body of the antenna is mounted on the instrument panel side mounting section, and when the first engagement unit and the second engagement unit are disengaged from each other, the bracket holding the body of the antenna is dismounted from the instrument panel side mounting section.

According to this configuration, such first bracket and screws for mounting the antenna assembly to the instrument panel as in the foregoing prior art are no longer needed, and the antenna assembly (here a combined assembly of both the antenna body and bracket) can be mounted on the instrument panel easily without an increase in the number of parts.

BRIEF DESCRIPTION OF THE DRAWINGS

Other objects, features and advantages of the present invention will become more apparent from the following detailed description made with reference to the accompanying drawings, in which.

DETAILED DESCRIPTION

An embodiment of the present invention will be described in the following with reference to the accompanying drawings.

Figure 1:
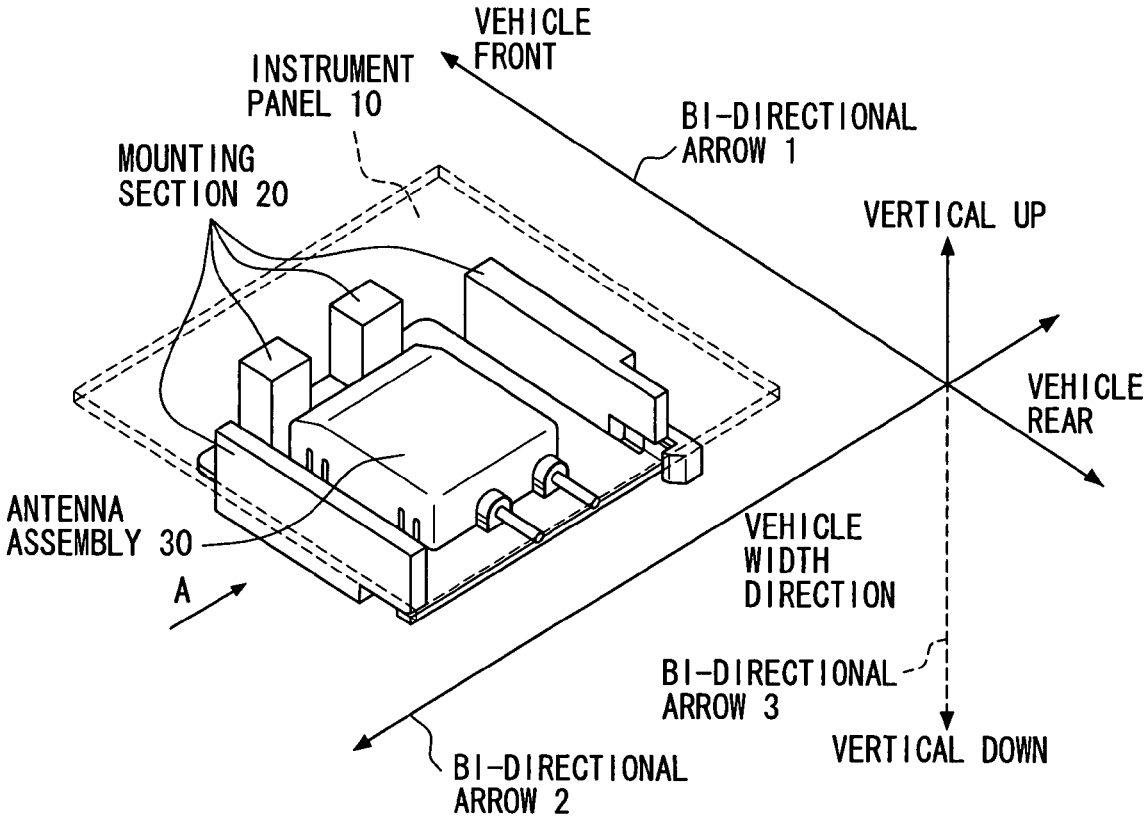
FIG. 1 shows a perspective view of an antenna mounting assembly in an embodiment of the present disclosure.
Figure 10:
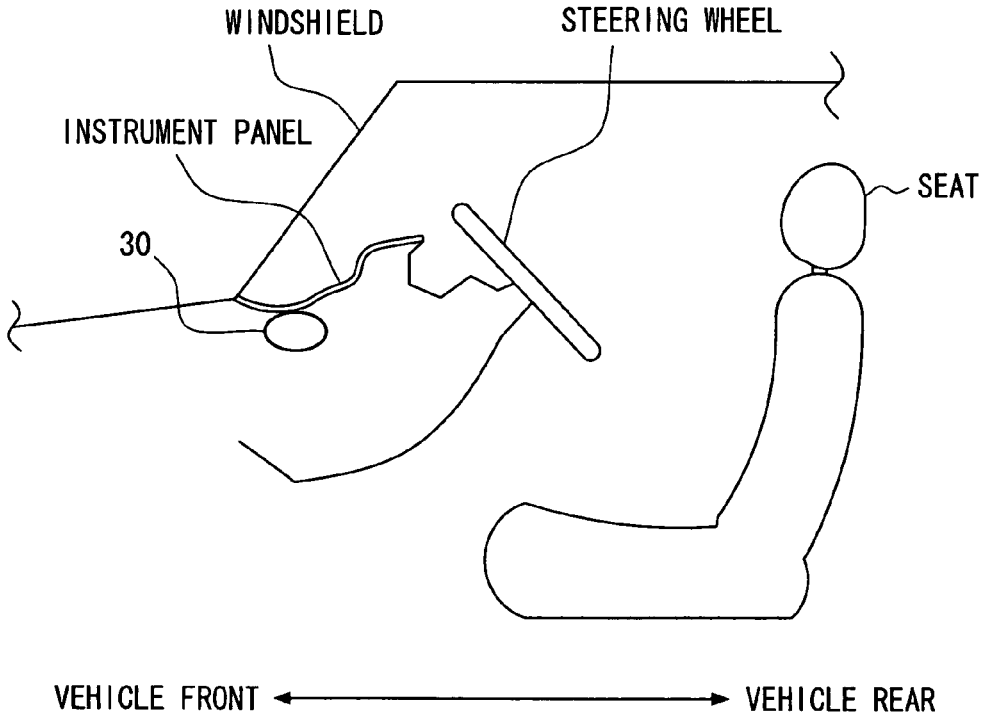
FIG. 10 shows another illustration of a position of the antenna mounting assembly in a vehicle.
Figure 11:
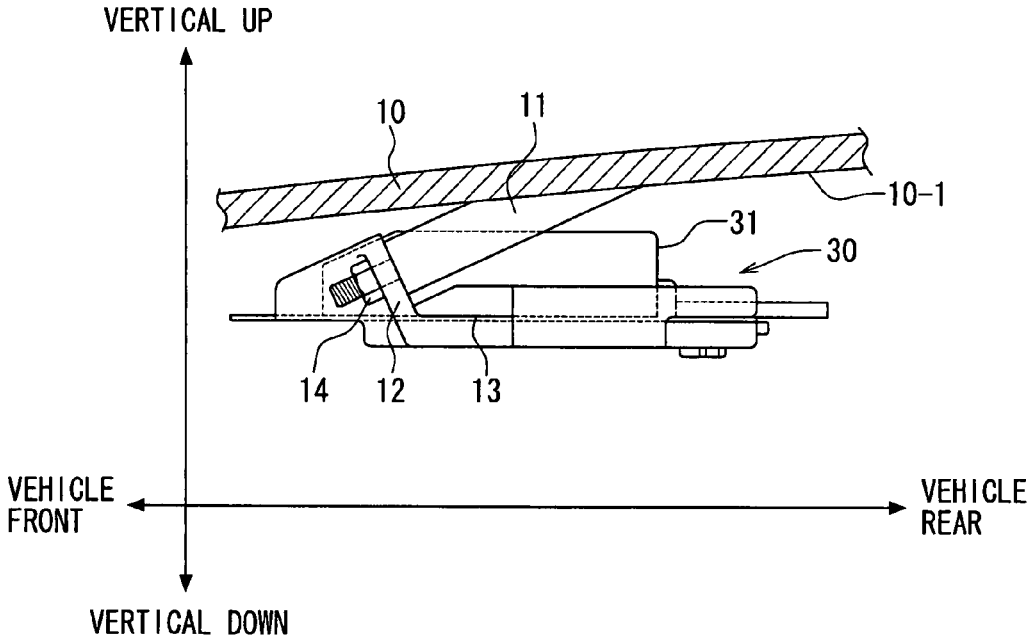
FIG. 11 PRIOR ART
FIG. 11 shows an illustration of an antenna mounting assembly in a prior art.
Figure 12A:
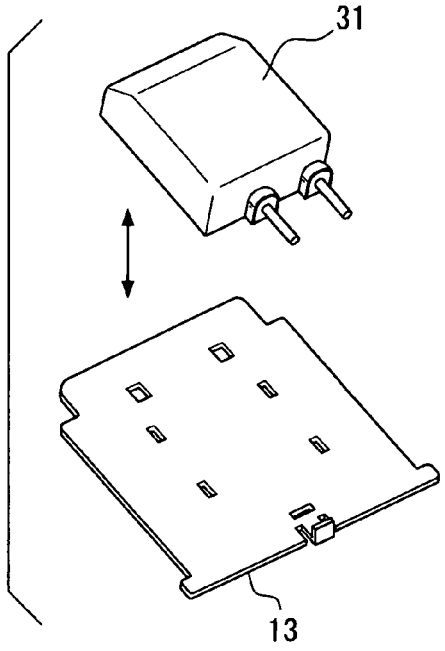
FIG. 12A PRIOR ART
FIGS. 12A and 12B show other illustrations of the antenna mounting assembly in a prior art.
Figure 12B:
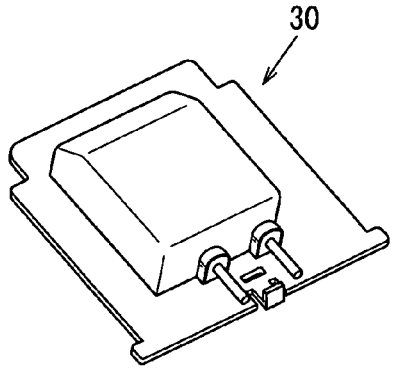
FIG. 12B PRIOR ART
Figure 13A:
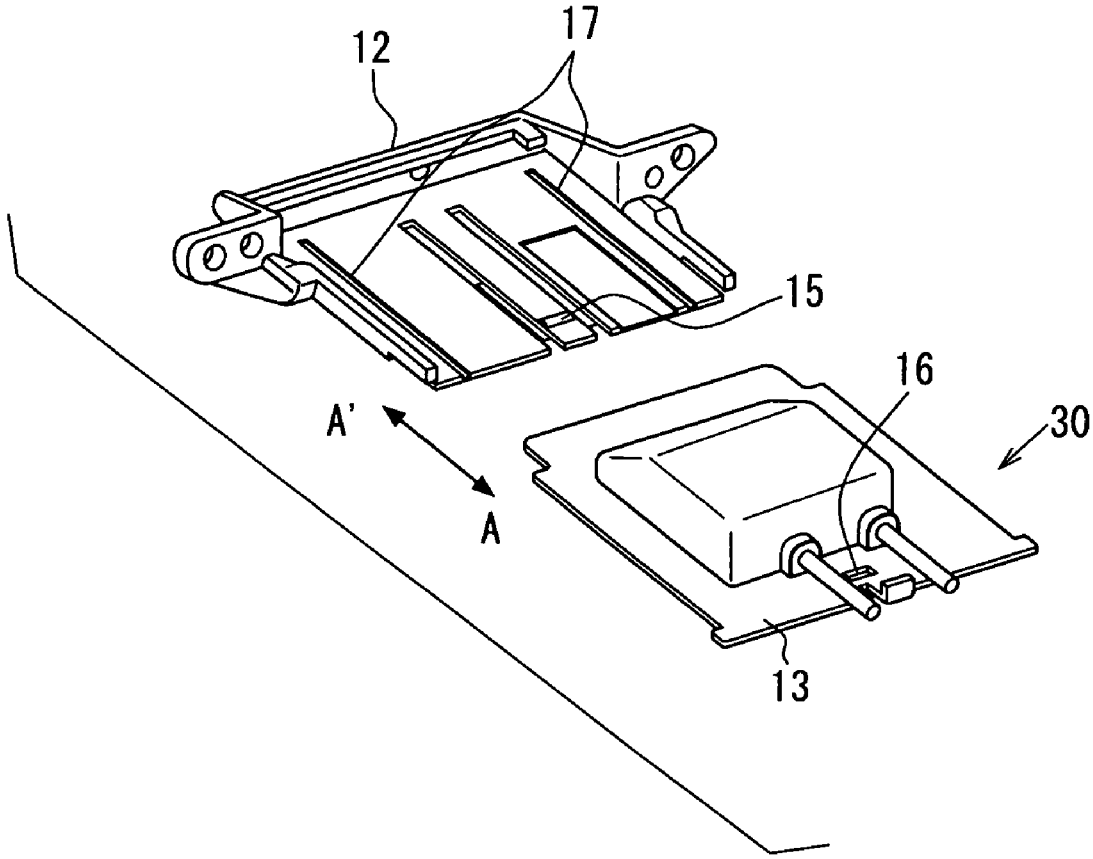
FIG. 13A PRIOR ART
FIGS. 13A and 13B show yet other illustrations of the antenna mounting assembly in a prior art.
Figure 13B:
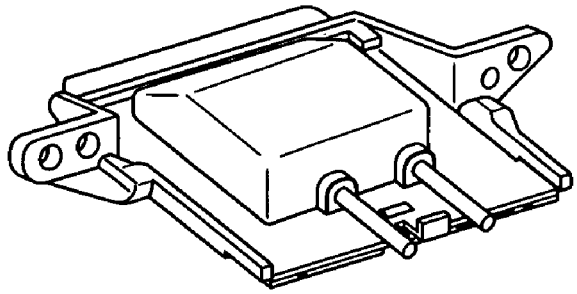
FIG. 13B PRIOR ART

FIG. 1 is a perspective view showing schematically a state in which an antenna assembly 30 is mounted to an instrument panel-side mounting section 20 and is thereby loaded to an instrument panel 10. (Taking the easiness of seeing the drawing into account, the portion of the instrument panel 10 corresponding to FIG. 10 is cut out in a square shape and is illustrated so that the interior thereof can be seen through). A description will be given below about the configuration of this embodiment.

A positional relation in the vehicle concerned is the same as that described above in connection with the prior art. That is, the antenna assembly 30 is disposed at a central part in the transverse direction of the vehicle and in a front portion of the vehicle. The relation of the antenna assembly 30 to the vehicle in the longitudinal, transverse and vertical directions is as indicated with bidirectional arrows 1 to 3.

The bidirectional arrow 1 indicates the longitudinal direction of the vehicle and the bidirectional arrow 2 indicates the transverse direction of the vehicle. A plane defined by the bidirectional arrows 1 and 2 is a horizontal plane. On the other hand, it is the bidirectional arrow 3 that indicates the vertical direction. A description will be given below first about the instrument panel-side mounting section 20.

Figure 2A:
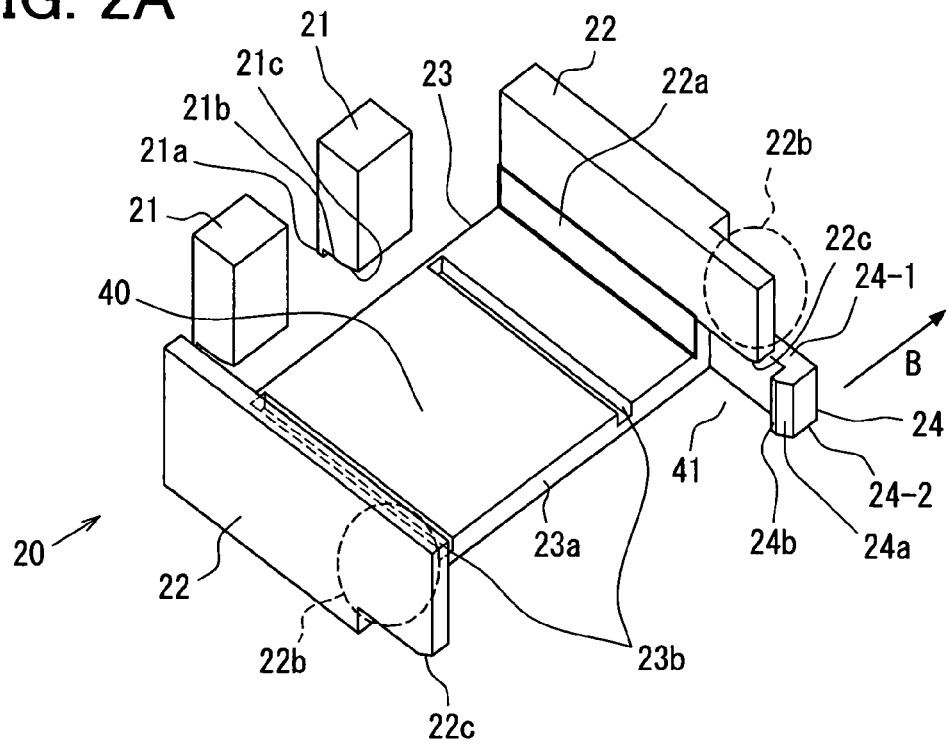
FIGS. 2A and 2B show perspective views of an instrument panel side mounting section of the assembly.
Figure 2B:
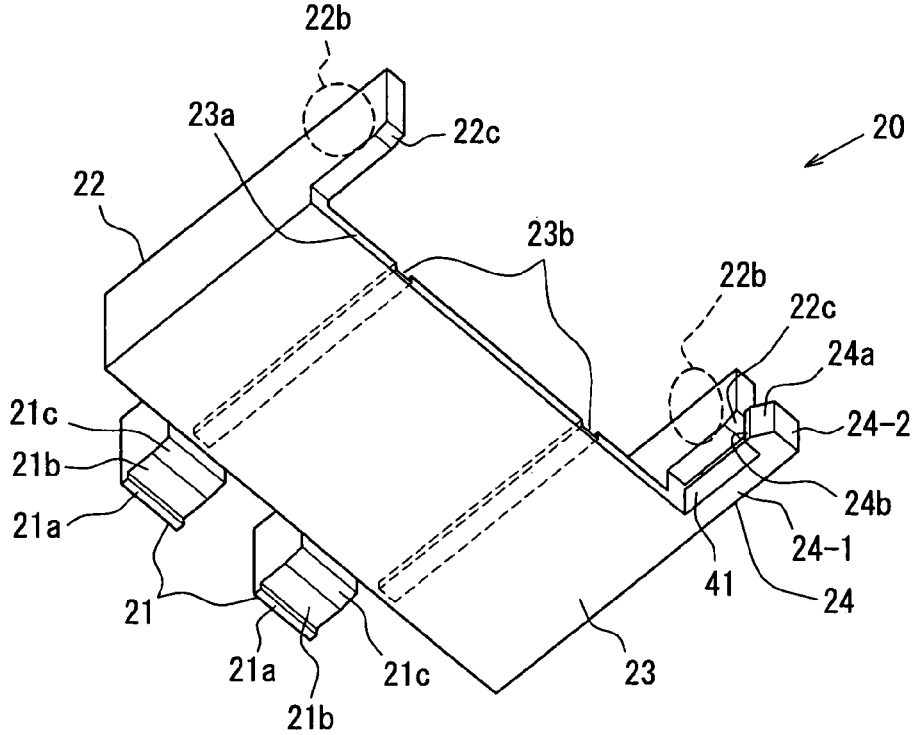

The instrument panel-side mounting section 20 is formed integrally with the instrument panel 10 by resin molding when fabricating the instrument panel. The instrument panel-side mounting section 20 is for mounting the antenna assembly 30 to be described later. FIG. 2A is a perspective view of the instrument panel-side mounting section 20 and FIG. 2B is a perspective view of the instrument panel-side mounting section 20 as seen from below. In FIGS. 2A and 2B, the instrument panel 10 is not shown in order to make the drawings easy to see.

As shown in FIGS. 2A and 2B, the instrument panel-side mounting section 20 is roughly made up of front pressing portions 21 for mounting the antenna assembly 30, side portions 22 for holding and smoothly mounting the antenna assembly 30, a holding portion 23 for holding the antenna assembly 30, and an anti-dislodgment portion 24 for fixing the antenna assembly 30 to the instrument panel-side mounting section 20 and preventing it from falling off backward of the vehicle. More detailed structures of these components will be described below.

Figure 3:
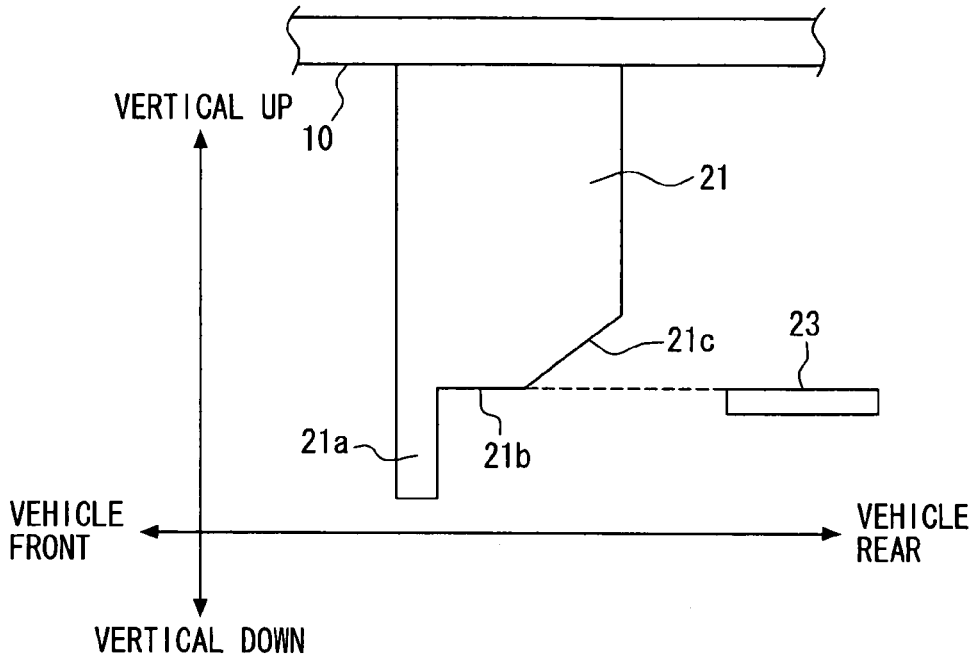
FIG. 3 shows an illustration of a front side pressing portion of the mounting section of the assembly.

As shown in FIG. 3 (showing the front pressing portions 21 as seen in the vehicular transverse direction), the front pressing portions 21 are square pillar shape projections extending downward from the instrument panel 10 at a predetermined spacing in the vehicular transverse direction. At lower ends of the front pressing portions 21 and at the foremost positions thereof in the vehicle there are formed stoppers 21*a* respectively against which a bracket 32 comes into abutment when the antenna assembly 30 is mounted. Further, at the lower end of each front pressing portion 21 and on the rear side thereof in the vehicle, there are formed a horizontal portion 21*b*, the horizontal portion 21*b* being adapted to receive pressure upward by the bracket 32 of the antenna assembly 30 and undergo an elastic deformation to prevent wobbling at the time of mounting the antenna assembly, and a slant portion 21*c* for effecting the mounting smoothly.

As shown in FIG. 2A, the side portions 22 and the holding portion 23 are integral with each other. The side portions 22 comprise long plate members extending downward from the instrument panel 10 and disposed through a predetermined spacing. The holding portion 23 is formed by a horizontal plate member disposed so as to connect lower ends of the pair of plate members of the side portions 22. The holding portion 23 forms a bottom of the instrument panel-side mounting section 20. That is, when the side portions 22 and the holding portion 23 alone are seen in the longitudinal direction of the vehicle, they are in U-shape. Since the instrument panel 10 serves as a ceiling portion, the side portions and the holding portion define a generally square shape portion under the instrument panel 10 and a hollow portion 40, which is a generally square shape space, is formed inside the said generally square shape portion. By the "predetermined spacing" as referred to herein is meant a width in the vehicular transverse direction.

Figure 4:
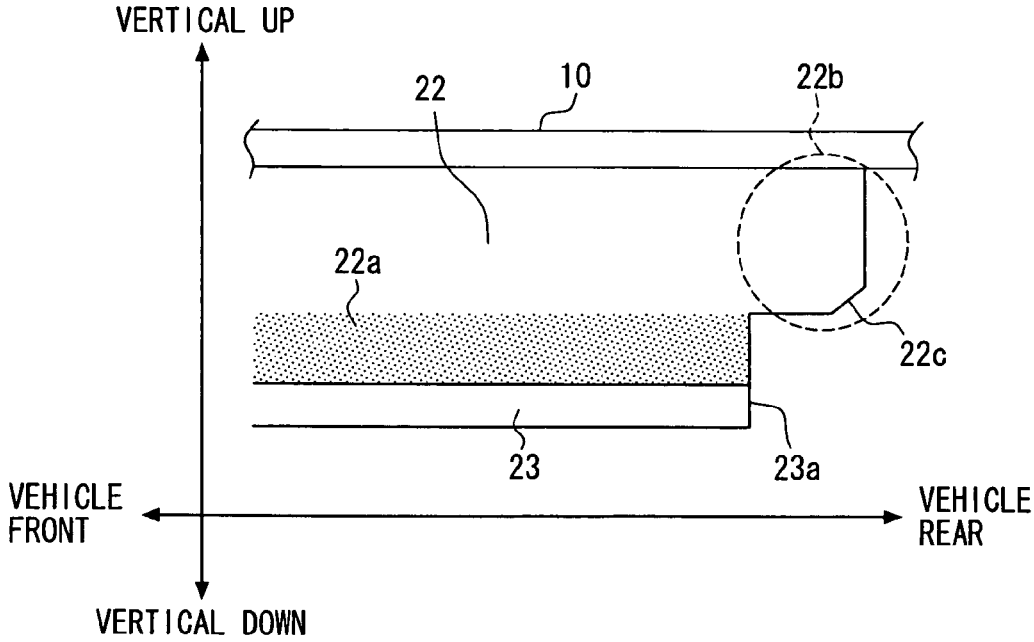
FIG. 4 shows an illustration of a side portion of the mounting section of the assembly.

As shown in FIG. 4 (a sectional view obtained by cutting the instrument panel-side mounting section 20 along a vertical plane in the vehicular longitudinal direction, the side portions 22 corresponding to both sides of the hollow portion 40 have respective guide portions 22*a* (the solid portion in FIG. 4) extending vertically upward from the holding portion 23 which corresponds to a bottom of the hollow portion 40. The guide portions 22*a*, which are located at the lowest end positions of the side portions 22, function to guide the antenna assembly 30 when mounting the same assembly.

Further, in each side portion 22 there is formed a rear pressing portion 22*b* (the portion enclosed with a broken line in FIG. 4) which projects backward of the vehicle from the rear end face 23*a* of the holding portion 23 serving as a bottom, and a rear-end corner thereof is beveled to form a slant 22*c* for smoothing the antenna assembly mounting work.

As shown in FIGS. 2A and 2B, grooves 23*b* are formed in an upper surface of the holding portion 23 to prevent interference between the antenna assembly 30 and the holding portion 23 when mounting the antenna assembly and assist the function of the guide portions 22*a*.

The anti-dislodgment portion 24 is formed in one of the paired side portions 22 and projects from the side portion 22 backward of the vehicle with respect to the end face 23*a* of the holding portion 23. As shown in detail in FIG. 5 (viewing the anti-dislodgment portion 24 and the vicinity thereof vertically from above), the anti-dislodgment portion 24 is made up of a plate-like base portion 24-1 projecting backward of the vehicle from the end face 23*a* and a bent portion 24-2 extending from a rear end of the base portion 24-1 and bent to the hollow portion 40 side in the vehicular transverse direction.

The base portion 24-1 and the bent portion 24-2 are formed as an L-shaped projection (the tip is bent toward the central part of the vehicle) when seen vertically from above. As shown in FIG. 2B, the rear pressing portion 22*b* of one side portion 22 extends so as to cover the L-shaped portion vertically from above to define a space 41. The space 41 is a space surrounded by both the L-shaped portion and a lower surface of the rear pressing portion 22*b*.

When the antenna assembly 30 is mounted, a part (34 to be described later) of the antenna assembly 30 is inserted into the space 41, whereby the antenna assembly 30 is fixed so as not to fall off backward of the vehicle. That is, the bent portion 24-2 acts to prevent the antenna assembly 30 from falling off backward of the vehicle. This point will be described in detail later.

For insertion of the antenna assembly 30 into the space 41, the anti-dislodgment portion 24 is formed so as to deflect in the direction of arrow B in FIG. 2B upon application thereto of pressure in the arrow B direction in FIG. 2A and revert in the opposite direction upon release of the pressure.

Figure 5:
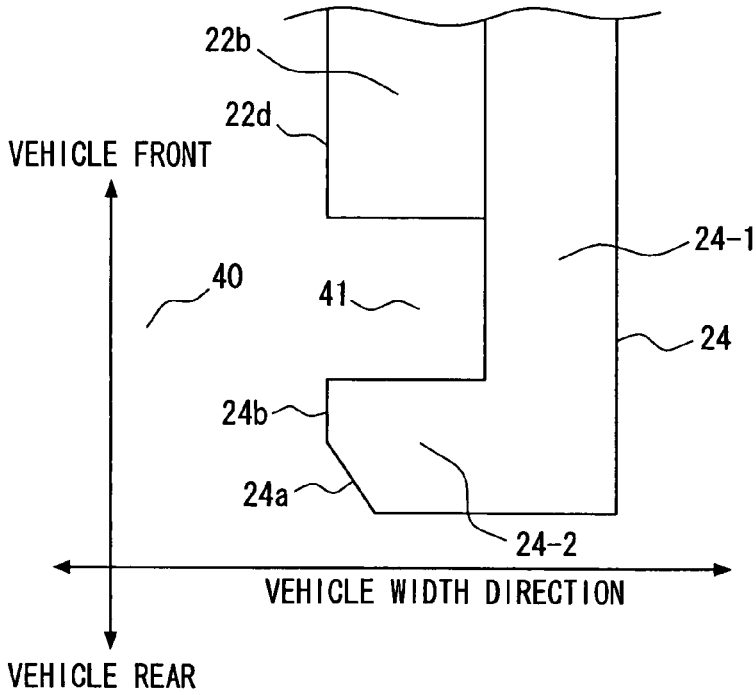
FIG. 5 shows an illustration of an engagement between the instrument panel side mounting section and a bracket.

As shown in FIG. 5 (viewing the anti-dislodgment portion 24 and the vicinity thereof vertically from above), at the tip of the bent portion 24-2 there are formed a slant portion 24*a* as a beveled corner and a plane portion 24*b*. The slant portion 24*a* is for smoothing the antenna assembly mounting work, while the plane portion 24*b* is for causing the aforesaid deflection to be induced by the antenna assembly 30 when mounting the same assembly.

For forming the portion of such a complicated shape (the instrument panel-side mounting section 20) integrally with the instrument panel 10 by resin molding, there may be used a slide mold. More specifically, a first mold (not shown) for forming the anti-dislodgment portion 24, a second mold (not shown) for forming the side portions 22 and the holding portion 23, and a third mold (not shown) for forming the front pressing portions 21, are combined and resin is poured into the combined mold, then the first mold removed by sliding it downward to form the anti-dislodgment portion 24. Thereafter, the second mold is removed by sliding it backward of the vehicle to form the side portions 22, holding portion 23 and space 41. Further, the third mold is removed downward to form the front pressing portions 21. When removing the second mold, in order to avoid interference between the mold and the molded products, it is preferable for the plane portion 24*b* of the anti-dislodgment portion 24 not to project to the hollow portion 40 side (the hollow portion 40 defined by a part of the instrument panel 10 as a ceiling, side portions 22 as side faces and the holding portion 23 as a bottom) beyond a plane 22*d* of the side portion 22 concerned, as shown in FIG. 5. By so doing, it is possible to decrease the number of times of combining the slide molds and obtain a desired shape. In this embodiment, the two planes in question are assumed to be coplanar.

Figure 6A:
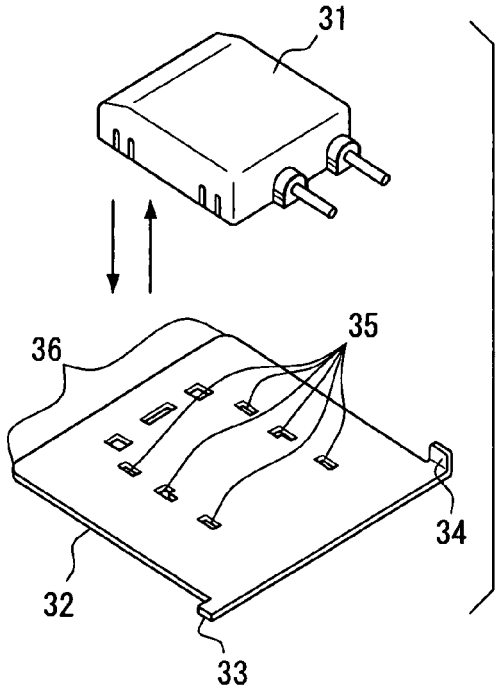
FIGS. 6A to 6B show perspective views of a body of the antenna and a bracket of the antenna mounting assembly in an assembly process.
Figure 6B:
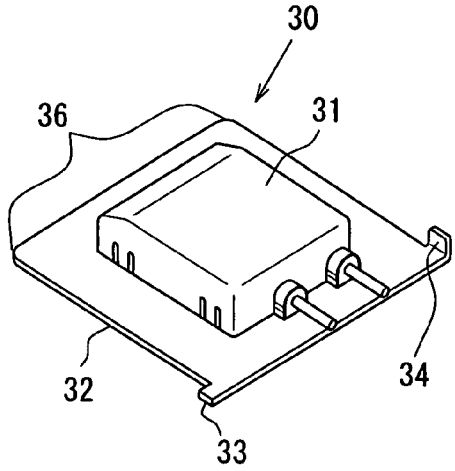

Next, the antenna assembly 30 will be further described with reference also to a perspective view of FIGS. 6A and 6B. As shown in a perspective view of FIG. 6A, the antenna assembly 30 is made up of an antenna body 31 and a bracket 32 for mounting the antenna body 31 to the instrument panel-side mounting section 20. The antenna body 31 and the bracket 32 are combined together into such a form as shown by a perspective view of FIG. 6B.

The antenna body 31 has, in the interior of a housing which is generally rectangular as a whole, an antenna element for ETC, an antenna element for GPS and an antenna element for VICS (Vehicle Information and Communication System in operation in Japan), with two cables being drawn out from the housing, one of the cables being for the ETC antenna element and the other being for both the GPS antenna element and VICS antenna element. Plural mounting pawls (not shown) for positioning and mounting the antenna body 31 to the bracket 32 are formed at predetermined positions in a lower surface of the housing.

The bracket 32 is formed by a metallic plate which acts as a ground of the above antenna elements. Plural mounting holes 35 are formed in the bracket 32 in predetermined positions correspondingly to the plural mounting pawls (not shown) formed on the lower surface of the antenna body 31. Additionally, the bracket 32 is formed with a lug 33 projecting in the vehicular width direction in the mounted state of the antenna assembly 30 to the instrument panel 10 and is also formed with a bent portion 34 correspondingly to the anti-dislodgment portion 24 of the instrument panel 10. Further, end portions (round portions) 36 each having a curve of a circle with radius R are formed at a front end on the vehicle front side of the bracket 32. The following description is now provided about these portions.

The lug 33 extends from an end of the metallic plate in the same direction as the plate surface. When the antenna assembly 30 is mounted to the instrument panel-side mounting section 20, the tip of the lug 33 presses a lower surface of the rear pressing portion 22*b* formed at a rear end of the associated side portion 22 of the instrument panel-side mounting section 20, causing it to deflect and thereby preventing wobbling of the antenna assembly.

The bent portion 34 is an L-shaped portion formed by being bent in the vertical direction with respect to the plane of the metallic plate. The bent portion 34 comes into fitting engagement with the anti-dislodgment portion 24, namely, it is fitted into the space 41 shown in FIG. 5, and thereby functions to prevent the antenna assembly 30 from falling off backward of the vehicle from the instrument panel-side mounting section 20. Further, the bent portion 34 functions like the lug 33 and prevents wobbling when mounting the antenna assembly.

The round portions 36 are for smoothing the mounting of both the antenna assembly 30 and instrument panel-side mounting section 20.

Figure 7:
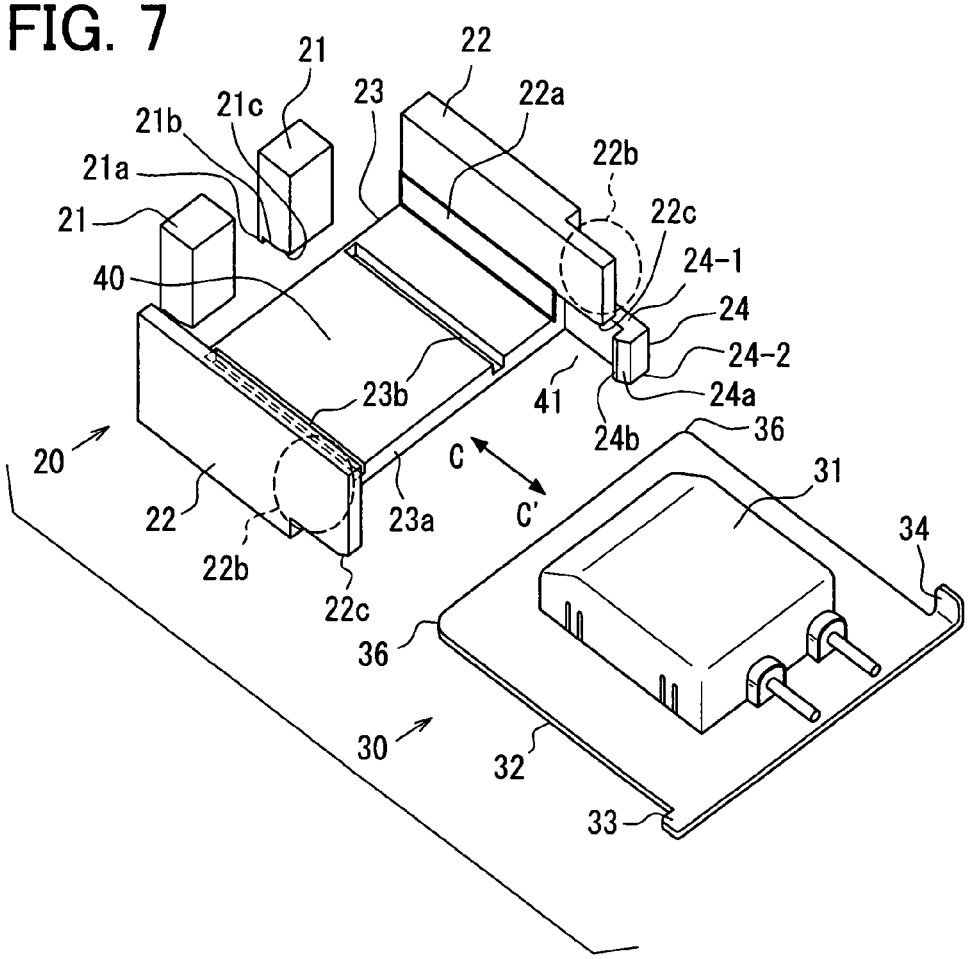
FIG. 7 shows of a perspective view of an antenna mounting assembly in the embodiment of the present disclosure in an assembly process.
Figure 8:
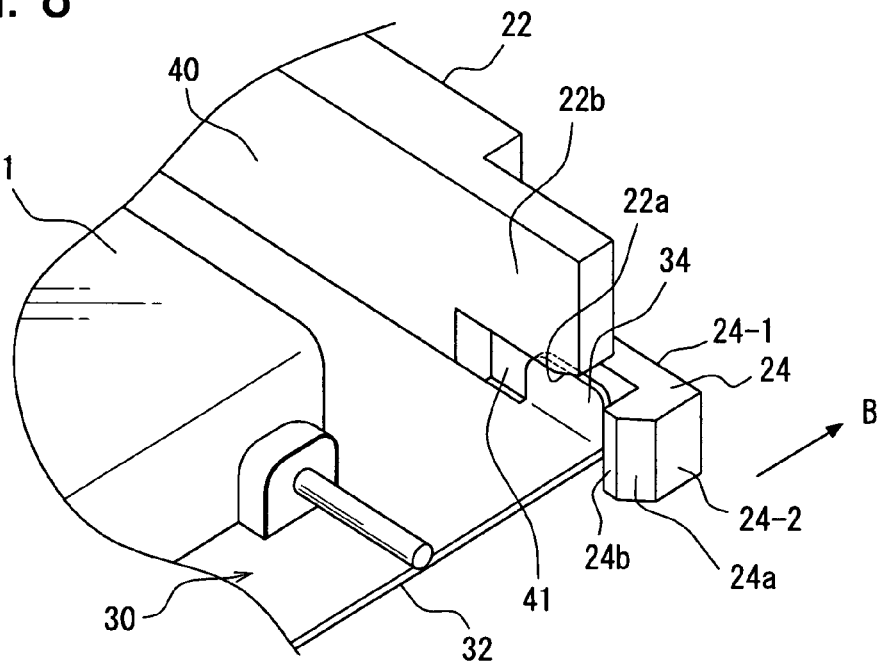
FIG. 8 shows of an enlarged perspective view of an antenna mounting assembly in the embodiment of the present disclosure in an assembly process.
Figure 9:
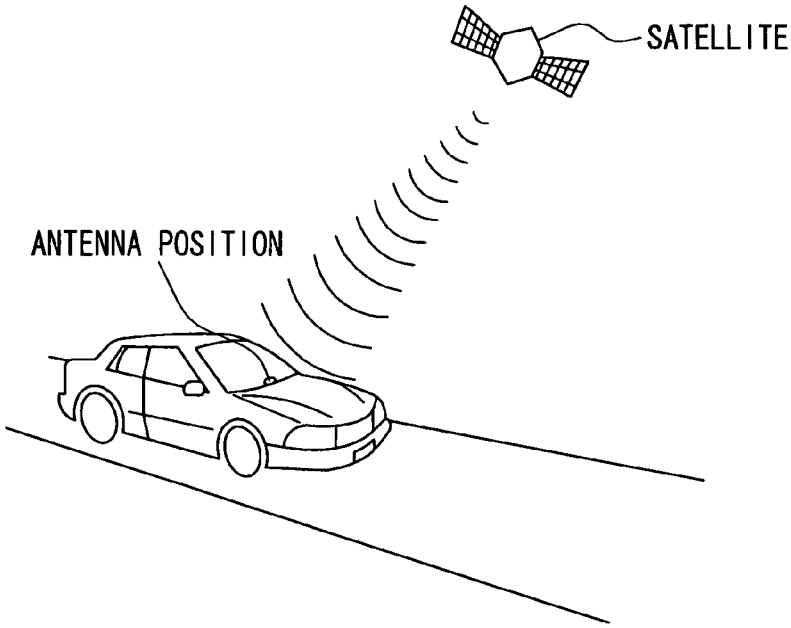
FIG. 9 shows an illustration of a position of the antenna mounting assembly in a vehicle.

Now, with reference to FIGS. 7 and 8, the following description is provided about in what procedure the antenna assembly 30 is mounted to the instrument panel 10.

This procedure is roughly performed as follows. First, a preparatory work is conducted. As shown in FIGS. 6A and 6B, the mounting pawls (not shown) of the antenna body 31 are hooked (fitted into) the mounting holes 35 formed in the bracket 32 to mount the antenna body 31 to the bracket, thereby constituting the antenna assembly 30. In this way the preparatory work for the antenna assembly 30 is completed.

Next, as shown in a perspective view of FIG. 7, the antenna assembly 30 is slid in the direction of arrow C (advancing toward the vehicle front side from the vehicle rear side) along the side portions 22 and the holding portion 23 of the instrument panel-side mounting section 20 and is started to be inserted into the hollow portion 40.

When starting this insertion, the bracket 32 and the bent portion 24-2 of the anti-dislodgment portion 24 may contact each other. However, since the round portions 36 are formed at the front end of the bracket 32 and the slant portion 24*a* is formed at the rear-end corner of the bent portion 24-2, these portions permit more smooth insertion of the bracket 32. Besides, since the antenna assembly 30 is inserted into the pocket-like hollow portion 40 enclosed with the pair of side portions 22 and the holding portion 23, it is easy for a worker to set a target for the insertion and mount the antenna assembly 30 to the instrument panel-side mounting section 20 in comparison with the mounting structure that does not have the hollow portion 40.

As the insertion of the antenna assembly 30 in the direction of C in FIG. 7, the front end of the bracket 32 reaches the end face 23*a* of the holding portion (also serving as end faces of the guide portions 22*a*) shown in FIG. 4. Also in this case, since the front end of the bracket is formed with round portions 36, the insertion of the bracket 32 inside the guide portions 22*a* can be done smoothly.

As the insertion is further continued, an upper surface of the lug 33 of the bracket 32 comes into contact with the slant portion 22*c* of the rear pressing portion 22*b* positioned on the left side and the bent portion 34 comes into contact with the slant portion 24*a* of the anti-dislodgment portion 24 of the instrument panel. Upon further continuance of the insertion, since a back side (vertically lower side) of the bracket 32 is in contact with the upper surface of the holding portion 23, the bracket 32 itself is in a fixed condition in terms of its vertical movement and the inserted lug 33 presses the lower surface of the rear pressing portion 22*b* upward. As a result, a lower end portion of the rear pressing portion 22*b* undergoes an elastic deformation. On the other hand, the bent portion 34 is moved in the direction of insertion by the slant portion 24*a* of the bent portion 24 of the instrument panel 10 and thereafter presses the horizontal portion 24*b* in the direction of arrow B (in the vehicle transverse direction) shown in FIG. 8. Consequently, the whole of the anti-dislodgment portion 24 deflects in the direction of arrow B.

As the insertion further continues, an upper end of the bent portion 34 comes into contact with the lower surface of the rear pressing portion 22*b* located on the right side and is pushed in toward the vehicle front side while pressing the lower surface of the rear pressing portion 22*b* upward. In this case, since the rear pressing portion 22*b* is formed with the slant portion 22*c*, the insertion of the bracket 32 can be done smoothly. Further, as noted above, since the back side (vertically lower side) of the bracket 32 is in contact with the upper surface of the holding portion 23, the bracket 32 itself is in a fixed condition in terms of its vertical movement. Consequently, as a result of the upper end of the bent portion 34 being pushed in toward the vehicle front side, the upper end causes the rear pressing portion 22*b* to be elastically deformed upward. At the same time, a front end of the bracket 32 reaches the front pressing portions 21. As shown in FIG. 3, the upper surface of the holding portion 23 and the horizontal portions 21*b* of the front pressing portions 21 are substantially flush with each other (that is, the lower surface of the bracket 32 and the horizontal portion 21*b* are substantially flush with each other), but also in this case the slant portions 21*c* permits smooth insertion of the bracket 32 and an upper surface of the bracket 32 is inserted while pressing the horizontal portions 21*b* upward.

Lastly, when the bent portion 34 passes the slant portion 24*a* and then the plane portion 24*b* completely, the pressure which has pressed the anti-dislodgment portion 24 in the direction of B is relieved and the deflected anti-dislodgment portion 24 reverts to its original state. As a result, the bent portion 34 is fitted into the space 41 and is fixed while being covered with the bent portion 24-2 from the rear side of the vehicle. That is, the bent portion 24-2 acts to prevent the antenna assembly 30 from falling off backward of the vehicle. At the same time, an upper surface of the bent portion 34 presses the lower surface of the associated rear pressing portion 22*b* and causes it to deform elastically. Further, the front end of the bracket 32 presses at two positions the horizontal portions 21*b* of the front pressing portions 21 upward, causing the horizontal portions to deform elastically, and at the same time comes into abutment against the stoppers 21*a* and is fixed thereby with respect to the front side of the vehicle.

Thus, in this embodiment, the bracket 32 is positioned and disposed on the upper surface of the holding portion 23, the front end of the bracket 32 is pressed at two positions by the horizontal portions 21*b* of the front pressing portions 21, and the upper surface of the lug 33 of the bracket 32 and the upper end of the bent portion 34 of the bracket are pressed against the lower surfaces of the rear pressing portions 22*b* respectively, whereby the antenna assembly 30 is loaded to the instrument panel-side mounting section 20. In other words, the bracket 32 is pressed upward from below by the holding portion 23 and is pressed downward from above by both the front and rear pressing portions 21, 22*b*, whereby the bracket 32 is held among those portions and the antenna assembly 30 is loaded to the instrument panel-side mounting section 20. In this state, the antenna assembly 30 is fixed from the front side of the vehicle and is prevented from falling off to the rear side of the vehicle. Consequently, the mounting of the antenna assembly 30 to the instrument panel 10 becomes stable.

With the grooves 23*b* formed in the holding portion 23, the mounting pawls of the antenna body can slide without interference with the holding portion 23 when mounting the antenna body; besides, since it is possible to assist the function of the guide portions, the mounting operation can be done smoothly.

Now, with reference to FIGS. 7 and 8, the following description is provided about the procedure for removing the antenna assembly 30 from the instrument panel 10. First, pressure is applied in the direction of arrow B in FIG. 8 to the anti-dislodgment portion 24 of the instrument panel 10, causing it to deflect. In this state, the antenna assembly 30 is slid in the direction of arrow C' (backward of the vehicle) in FIG. 7 and is removed from the instrument panel-side mounting section 20, whereby the antenna assembly 30 can be removed from the instrument panel 10. Since the anti-dislodgment portion 24 is provided in one of the paired side portions 22, the worker can remove the antenna assembly easily, for example, by deflecting the anti-dislodgment portion 24 with his or her one hand and pulling out the antenna assembly with the other hand.

According to the structure described above, the antenna assembly 30 is fixed by the instrument panel-side mounting section 20 with ease by sliding the bracket 32 into the hollow space 40 without increasing the number of parts for assembly, thereby increasing the convenience of the worker and reducing the production cost. In addition, the bracket 32 can easily be released from the fixed position by releasing the bent portion 34 from the anti-dislodgement portion 24, thereby increasing the convenience of the worker for having an access to the body of the antenna. Further, the antenna assembly 30 and the bracket 32 are elastically engaged with each other, thereby being prevented from wobbling.

Although the present invention has been fully described in connection with the preferred embodiment thereof with reference to the accompanying drawings, it is to be noted that various changes and modifications will become apparent to those skilled in the art.

For example, the slant portion 24*a* and the plane 22*d* may not be in the condition of coplanar. That is, the plane 22*d* may protrudes toward the hollow space 40.

Further, a lower surface of the horizontal portion 21*b* and of the rear pressing portion 22*b* may have a small projected portion that extends downward therefrom for preventing wobbling by receiving an upward pressure from the antenna assembly 30.

Furthermore, the number of the front pressing portions 21 may be more than two, or just one instead of two as described in the above embodiment.

Furthermore, the holding portion 23 is in a U shape together with the side portions when seen from a rear or a front of the vehicle. That is, the holding portion brides the pair of the side portions. However, the holding portion 23 may not necessarily bridges the side portions. More practically, a portion between two grooves 23 in FIG. 2A is not required. By omitting this portion, the amount of the resin for forming this portion is reduced.

Furthermore, the antenna body 31 may house a single element antenna such as a GPS antenna element instead of an integrated element antenna having plural elements.

Such changes and modifications are to be understood as being within the scope of the present invention as defined by the appended claims.

What is claimed is:

1. An antenna mounting assembly comprising:

an instrument panel side mounting section that is integrally formed with an instrument panel of a vehicle having a first engagement unit formed thereon; and a bracket that holds a body of an antenna having a second engagement unit formed thereon, wherein, when the first engagement unit and the second engagement unit are engaged with each other, the bracket holding the body of the antenna is mounted on the instrument panel side mounting section, when the first engagement unit and the second engagement unit are disengaged from each other, the bracket holding the body of the antenna is dismounted from the instrument panel side mounting section, the instrument panel side mounting section further comprises a pair of side portions respectively formed on the instrument panel a predetermined distance from each other in a lateral direction of the vehicle and a holding portion that extends in the lateral direction of the vehicle to connect respective edges of the pair of the side portions, the instrument panel side mounting section has a hollow portion that is defined as a space surrounded by the pair of the side portions and the holding portion, the bracket holding the body of the antenna is slidably inserted into the space of the hollow portion from a rear side of the vehicle toward a front side of the vehicle, the side portions include respective rear side pressing portions that extend rearward from respective rear ends of the side portions, a pair of front side pressing portions are disposed a predetermined distance from each other in a vehicle front side area relative to the rear side pressing portions, and the rear side pressing portions are elastically deformed in an upward direction of the vehicle, and the pair of the front side pressing portions are elastically deformed, to press-fit the bracket into the hollow portion.

2. The antenna mounting assembly as in claim 1, wherein a vehicle front side of the front side pressing portions relative to elastically deformable portions of the front side pressing portions each have a stopper portion that extends in a downward direction of the vehicle, and the bracket has a vehicle front side edge that abuts each of the stopper portions.

3. The antenna mounting assembly as in claim 2, wherein one of the side portions has an anti-dislodge portion that extends toward a vehicle rear side with an L shape front end formed thereon, and the anti-dislodge portion serves as a part of the bracket for preventing dislodgement of the bracket with its front end positioned in a far rear area relative to a vehicle rear side of the bracket for the engagement.

4. The antenna mounting assembly as in claim 3, wherein, when the vehicle rear side of the bracket is positioned at a vehicle front area relative to the front end of the anti-dislodge portion by a deformation of the anti-dislodge portion toward lateral directions due to an insertion of the bracket in contact with the anti-dislodge portion, a release of a deformation force on the anti-dislodge portion toward the lateral directions restores an original shape of the anti-dislodge portion that serves as the part of the bracket for preventing the dislodgement of the bracket.

5. An antenna mounting assembly comprising:

an instrument panel side mounting section that includes a pair of laterally spaced-apart side portions, and that is integrally formed with a vehicle instrument panel, the side portions respectively including rear side pressing portions that extend rearward from respective ends of the side portions;

a bracket that holds an antenna body; and two laterally spaced-apart front side pressing portions located in a vehicle front side area relative to the rear side pressing portions, wherein the front side pressing portions and the rear side pressing portions are elastically deformed to press-fit the bracket between the side portions and to thereby mount the bracket to the instrument panel side mounting section.

* * * * *